US012716676B1

(12) United States Patent
Maschin et al.

(10) Patent No.: US 12,716,676 B1
(45) Date of Patent: Aug. 25, 2026

(54) TOY PROJECTILE LAUNCHER AND APPARATUS

(71) Applicant: Hasbro, Inc., Pawtucket, RI (US)

(72) Inventors: Robert C Maschin, Johnston, RI (US); Robert J DeRoche, Glocester, RI (US); Dan Luther, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 164 days.

(21) Appl. No.: 18/232,080

(22) Filed: Aug. 9, 2023

Related U.S. Application Data

(60) Provisional application No. 63/397,332, filed on Aug. 11, 2022.

(51) Int. Cl.
*F41B 4/00* (2006.01)
*F41B 7/08* (2006.01)
*F41B 11/89* (2013.01)

(52) U.S. Cl.
CPC ..... *F41B 4/00* (2013.01); *F41B 7/08* (2013.01); *F41B 11/89* (2013.01)

(58) Field of Classification Search
CPC ..... F41B 5/00; F41B 11/89; F41B 7/08
USPC ..... 124/71–74, 78
See application file for complete search history.

(56) References Cited

U.S. PATENT DOCUMENTS 1,403,719 A 1/1922 Szepe
3,262,440 A 7/1966 Kuhn
4,010,566 A 3/1977 Edwards
4,070,783 A 1/1978 Edwards
4,128,957 A * 12/1978 Lee ..... F41C 23/10 42/71.02
4,302,898 A 12/1981 LaRue
4,601,123 A 7/1986 Swearengen et al.
4,715,514 A 12/1987 Vidondo
4,750,900 A * 6/1988 Hart ..... A63H 13/04 446/308
4,796,893 A 1/1989 Choi
4,882,973 A 11/1989 Piscetta
5,282,454 A 2/1994 Bell et al.
D354,997 S 1/1995 Arad et al.
RE35,412 E 12/1996 Johnson et al.
5,611,321 A 3/1997 Hoeting et al.
5,944,006 A 8/1999 Moore et al.
5,984,788 A 11/1999 Lebensfeld et al.
6,119,671 A 9/2000 Smith et al.
6,261,180 B1 7/2001 Lebensfeld et al.
6,273,781 B1 * 8/2001 Yamasaki ..... A63H 3/20 446/298

(Continued)

*Primary Examiner* — John E Simms, Jr.
(74) *Attorney, Agent, or Firm* — Perry Hoffman

(57) ABSTRACT

Apparatus and methods employing dual launch and/or non-launching secondary functions configuring operation of launchers as between one of a first or a second position. Handle portions to the outer housing may be used for grasping the toy launcher with a user's hand, and a trigger may be used in launching the projectiles or amount of launchable matter. An exit aperture disposed in relation to a forward end of the outer housing, with the exit aperture being in general alignment with the chamber such that upon use of the trigger launching is provided with forward momentum through the exit aperture. A manual actuator is disposed in relation to the one or more handle portions of the outer housing for optional use to actuate a feature of the toy launcher to reconfigure, adjust, or actuate the launcher.

13 Claims, 17 Drawing Sheets

(56) References Cited

U.S. PATENT DOCUMENTS

| | | | | |
|---|---|---|---|---|
| D449,354 | S | 10/2001 | Hornsby et al. | |
| 6,302,796 | B1 | 10/2001 | Lebensfeld et al. | |
| D454,166 | S | 3/2002 | Hornsby et al. | |
| D458,975 | S | 6/2002 | Hornsby et al. | |
| 6,494,194 | B2 * | 12/2002 | Shipachev | F41B 11/62 124/31 |
| 6,523,535 | B2 | 2/2003 | Rehlemper et al. | |
| 6,543,173 | B1 | 4/2003 | Golan | |
| 6,634,128 | B1 | 10/2003 | Vastag | |
| 6,698,128 | B2 | 3/2004 | Kessler | |
| D504,489 | S | 4/2005 | Cerovic | |
| D508,277 | S | 8/2005 | Cerovic | |
| 7,086,191 | B2 | 8/2006 | Orr | |
| 7,163,009 | B2 | 1/2007 | Brown et al. | |
| D557,355 | S | 12/2007 | Higuchi et al. | |
| 7,412,975 | B2 * | 8/2008 | Dillon, Jr. | F41B 11/62 102/440 |
| D588,214 | S | 3/2009 | Stadlbauer | |
| 7,603,998 | B2 | 10/2009 | Finstad | |
| 7,686,002 | B2 | 3/2010 | Andrews | |
| D635,620 | S | 4/2011 | Nadel | |
| 8,082,909 | B2 | 12/2011 | Sopkinsly et al. | |
| 8,109,032 | B2 | 2/2012 | Faifer | |
| D660,926 | S | 5/2012 | Mastin | |
| 8,186,337 | B2 | 5/2012 | Nadel | |
| D664,609 | S | 7/2012 | Johnson | |
| 8,453,634 | B2 | 6/2013 | Chen | |
| 8,820,305 | B2 | 9/2014 | Victor et al. | |
| 8,875,688 | B2 | 11/2014 | Nugent | |
| 8,955,503 | B2 | 2/2015 | Corsiglia et al. | |
| 9,004,053 | B1 | 4/2015 | Anderson | |
| 9,097,476 | B2 | 8/2015 | Mead et al. | |
| 9,097,477 | B1 | 8/2015 | Mead et al. | |
| 9,816,771 | B2 | 11/2017 | Ghitti | |
| 9,958,230 | B1 | 5/2018 | Nugent et al. | |
| D834,112 | S | 11/2018 | Chu | |
| D876,572 | S | 2/2020 | Ding et al. | |
| 10,627,187 | B1 | 4/2020 | Lin et al. | |
| 10,641,567 | B2 | 5/2020 | Weilharter | |
| 10,648,763 | B2 | 5/2020 | Chia et al. | |
| 10,648,767 | B2 | 5/2020 | Chia et al. | |
| 10,767,944 | B2 | 9/2020 | Chen et al. | |
| D903,789 | S | 12/2020 | Zheng | |
| 10,871,343 | B2 | 12/2020 | Chia et al. | |
| 11,029,114 | B2 | 6/2021 | McDonald et al. | |
| 11,346,624 | B2 | 5/2022 | DeRoche et al. | |
| 2005/0016514 | A1 * | 1/2005 | Nadel | F41B 11/642 124/56 |
| 2007/0181114 | A1 * | 8/2007 | Tippmann | F41B 11/51 42/114 |
| 2010/0093254 | A1 * | 4/2010 | Jung | A63H 3/48 446/376 |
| 2011/0000473 | A1 * | 1/2011 | Perron | F41B 7/08 124/16 |
| 2011/0168149 | A1 | 7/2011 | Nadel | |
| 2012/0037135 | A1 * | 2/2012 | Dakan | F41B 7/08 124/16 |
| 2013/0112184 | A1 * | 5/2013 | Corsiglia | F41B 4/00 124/78 |
| 2021/0102769 | A1 * | 4/2021 | DeRoche | F41A 9/02 |
| 2022/0003518 | A1 * | 1/2022 | Lort | F41B 11/70 |

* cited by examiner

TOY PROJECTILE LAUNCHER AND APPARATUS

PRIORITY CROSS-REFERENCE TO RELATED APPLICATIONS

This application claims priority pursuant to 35 U.S.C. 119 (e) from U.S. Provisional Patent Application No. 63/397,332 filed on Aug. 11, 2022.

1. FIELD OF THE INVENTION

The present invention relates generally to toy launcher apparatus employing manual actuators and more particularly, to one or more launch and/or non-launching secondary functions for positioning or configuring operation of launchers as between one of a first or a second position or configuration thereon with secondary functions and the like.

2. BACKGROUND OF THE INVENTION

Projectile launcher mechanisms that safely launch projectiles or projected matter of various forms and types are well known. U.S. Pat. No. 11,346,624 issued in 2022 discloses a projectile loading system for a toy launcher, U.S. Pat. No. 8,820,305 shows a toy projectile launcher, and U.S. Pat. No. 7,163,009 issued in 2007 discloses a toy gun for launching foam projectiles. For example, Applicants' Assignees' U.S. Pat. Nos. 9,097,476 and 9,097,477 to Mead, et al. for "Projectile launcher with rotatable clip connector" illustrates and describes, in detail, toy launcher apparatus with a rotatable clip connector magazine clip alignments with the barrel portion toward spinning flywheels motor assembly for discharge, and is incorporated into the presented disclosure by reference in their entirety. Branded products that have been on the market for such or similar devices under the NERF® brand. Also known is an accessory holder for a handheld firearm such as claimed in U.S. Pat. No. 8,109,032.

Many such devices are intended for single-handed gripping of a handle with a trigger that activates launching being easily accessible to and activated by one or more fingers from the user's gripping hand while gripping the handle. This leaves a user's non-gripping arm/hand free to balance or steady himself or herself or to use such free hand to grasp additional projectiles for loading into the launcher, for example. However, while such uses of the free arm/hand may be important, use of the free arm/hand for such purposes leaves it less able or unable to reconfigure, adjust, or actuate the launcher while it is being held in the gripping hand.

SUMMARY OF THE INVENTION

The present invention addresses shortcomings of the prior art to provide a toy launch apparatus and methods facilitating one's being able to manually actuate a feature of a toy launcher with the same hand that is gripping the toy and able to launch one or more projectiles or an amount of launchable matter therefrom. In some preferred embodiments, this may permit toggling between chambers loaded with projectiles or launchable matter, adjusting a nozzle near an exit aperture to affect exit parameters of launched projectiles or matter through the aperture, releasing an emptied magazine or cartridge carrying extra launchable projectiles or matter, deploying and/or retracting an adjoining shield, raising, adjusting, and/or changing the visual zoom ratio on a scope, or providing access to an internal chamber for facilitating manual insertion of projectiles with the free hand.

Briefly, the present inventions relate to a toy launcher having a chamber within an elongated outer housing for receiving and temporarily containing projectiles or amount of launchable matter. One or more handle portions to the outer housing may be used for grasping the toy launcher with a user's hand, and a trigger may be used in launching the projectiles or amount of launchable matter. An exit aperture disposed in relation to a forward end of the outer housing, with the exit aperture being in general alignment with the chamber such that upon use of the trigger launching is provided with forward momentum through the exit aperture. A manual actuator is disposed in relation to the one or more handle portions of the outer housing for optional use to actuate a feature of the toy launcher to reconfigure, adjust, or actuate the launcher.

BRIEF DESCRIPTION OF THE DRAWINGS

For the purpose of facilitating an understanding of the inventions, the accompanying drawings and description illustrate preferred embodiments thereof, from which the inventions, structure, construction and operation, and many related advantages may be readily understood and appreciated.

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Referring now to FIGS. 1-3, a toy projectile launcher apparatus is illustrating an embodiment of a dual trigger and plural or multiple non-launching secondary functions of a rearward grip button or thumb selector for positioning or configuring operation of toy launchers as between one of a first or a second position or configuration on toy launchers, and related features. The toy launch apparatus has a housing with a barrel, a grip portion rearward of the barrel and further provided with launching, and/or non-launching secondary functions of a rearward grip button or thumb selector for positioning or configuring operation of toy launchers as between one of a first or a second position or configuration on toy launchers.

Figure 1A:
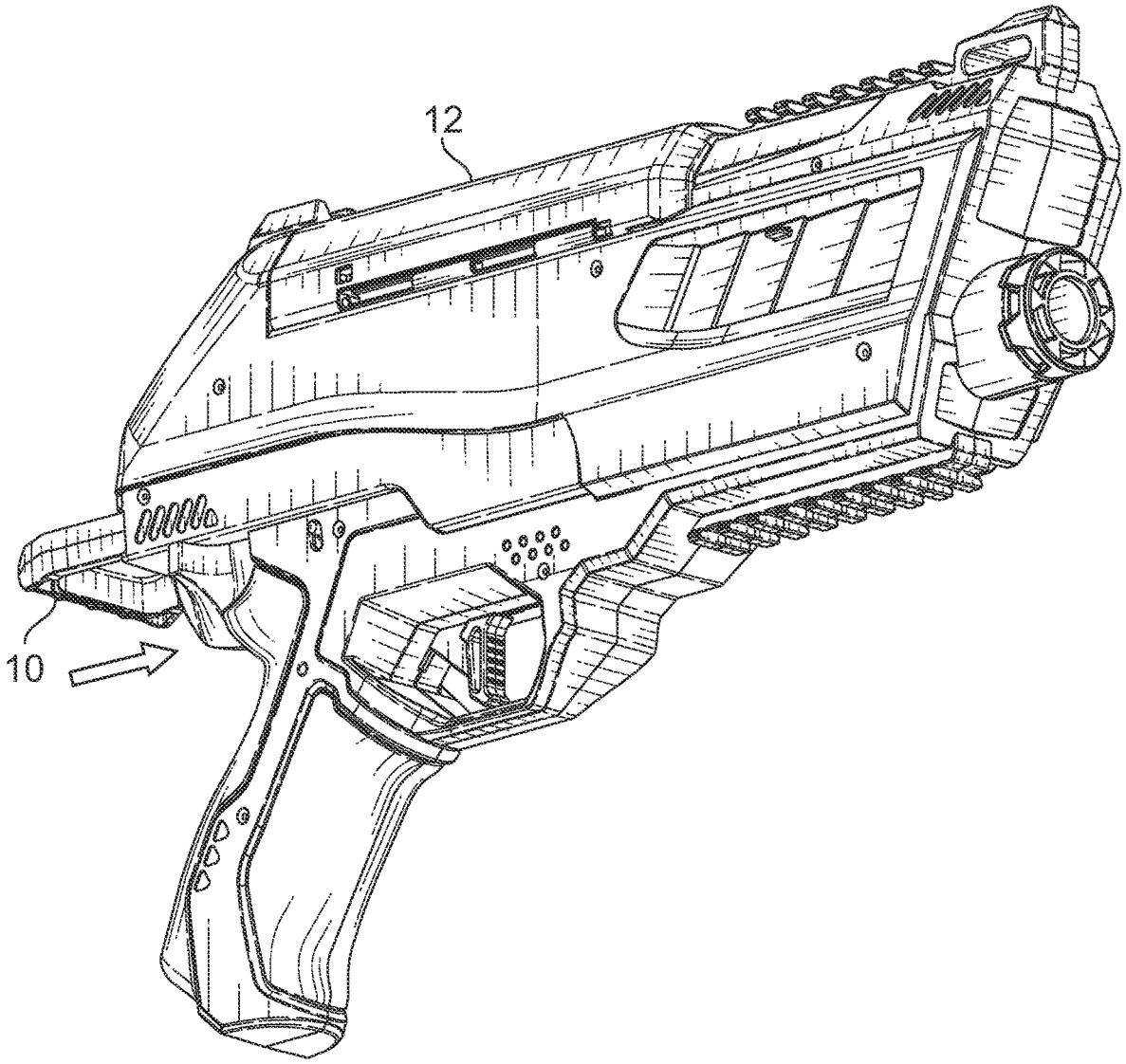
FIGS. 1A and 1B, FIGS. 2A and 2B are first and second perspective views of launcher embodiments where an actuator button engages bomb bay doors showing the actuator button depressed to engage the bomb bay doors, opening the doors with the button shown when pressed but closed when released, actuating doors in accordance the inventions.
Figure 1B:
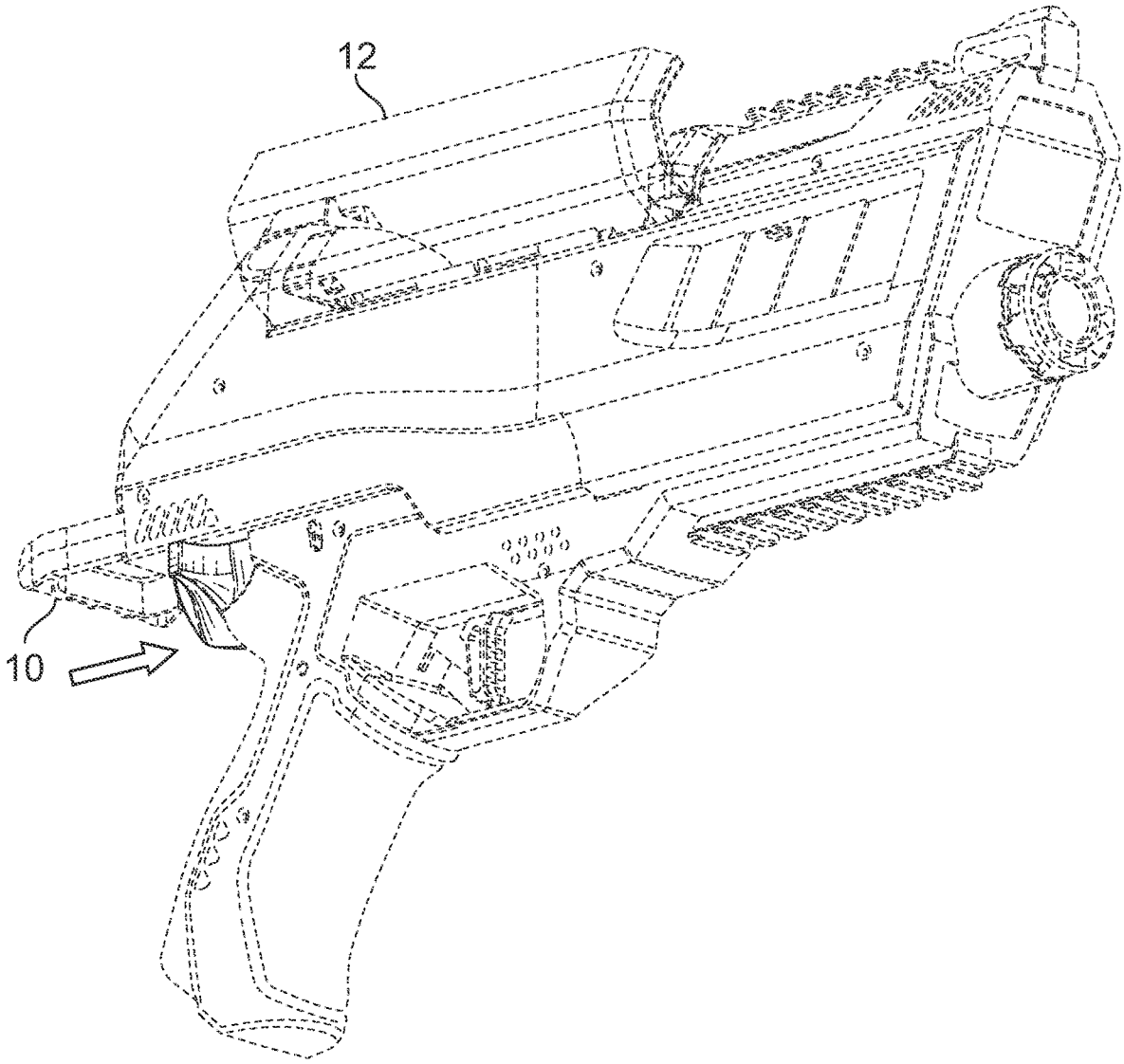

FIGS. 1A and 1B are first perspective views of launcher embodiments where the actuator button 10 engages bomb bay doors 12, where FIG. 1B shows the actuator button 10 depressed to engage the bomb bay doors, opening the doors with the button shown when pressed but closed when released, actuating doors in accordance the embodiments.

Figure 2A:
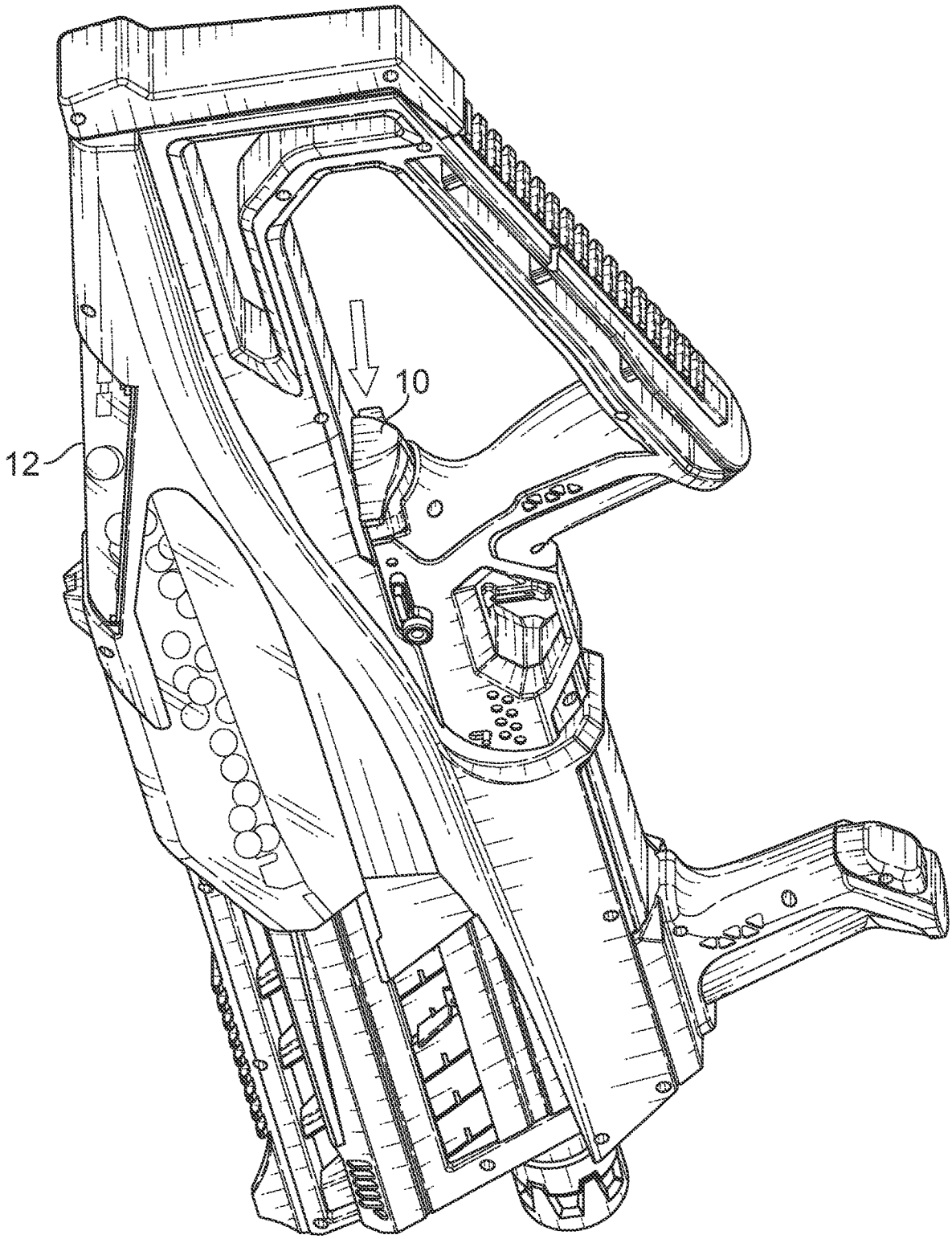
Figure 2B:
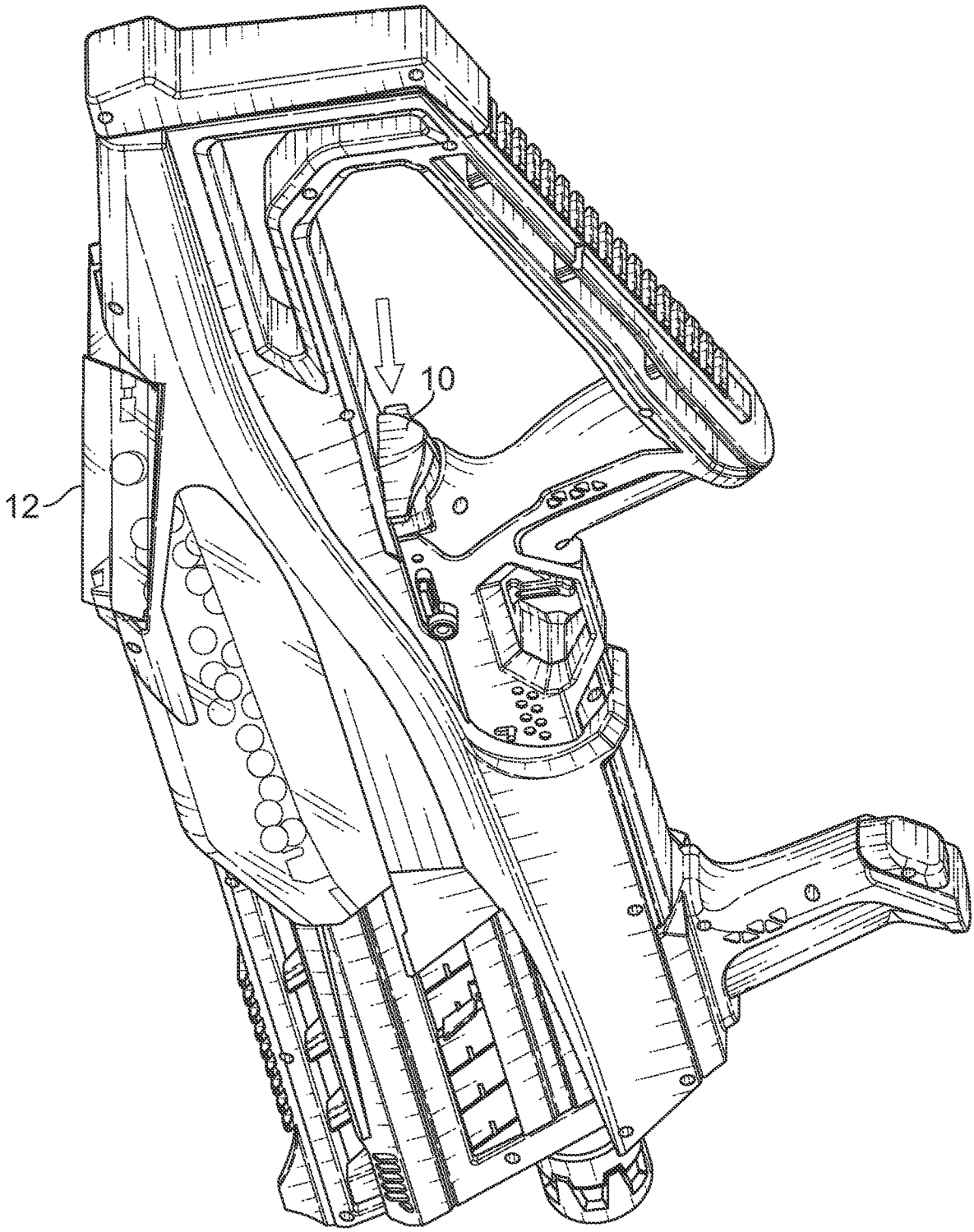

FIGS. 2A and 2B are second perspective views of launcher embodiments where the actuator button 10 engages bomb bay doors 12, where FIG. 2B shows the actuator button 10 depressed to engage the bomb bay doors, opening the doors with the button shown when pressed but closed when released, actuating doors in accordance the inventions.

Figure 2C:
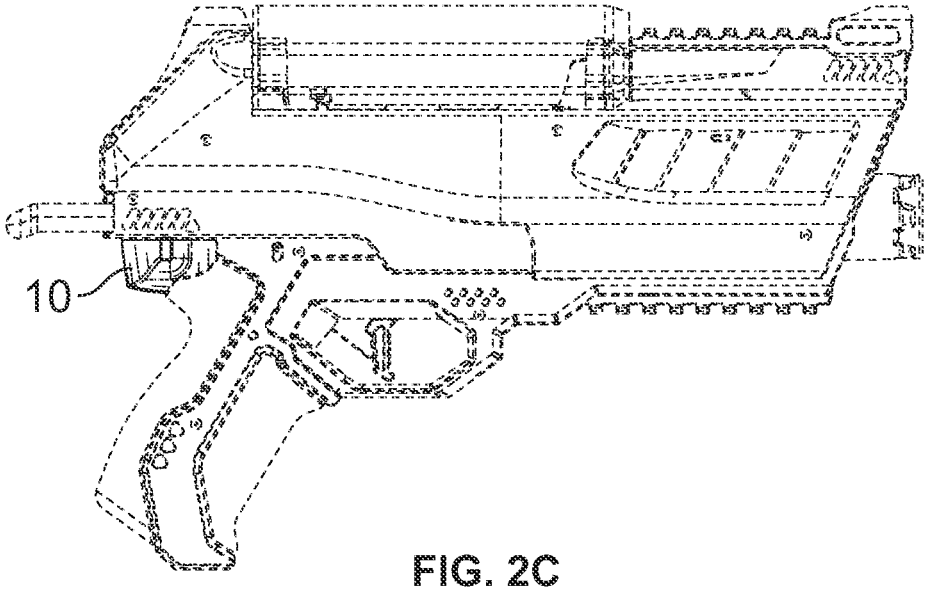
FIGS. 2C, 2D, 2E, 2F show a collection of alternate shaped button embodiments configured for actuation in various different fashions as engaging as being pressed for open, closed, side release engagements in accordance the inventions, for secondary functions of a rearward grip button or thumb selector for positioning or configuring operation of launchers as between one of a first or a second position or configuration on a rearward grip location with secondary functions.
Figure 2D:
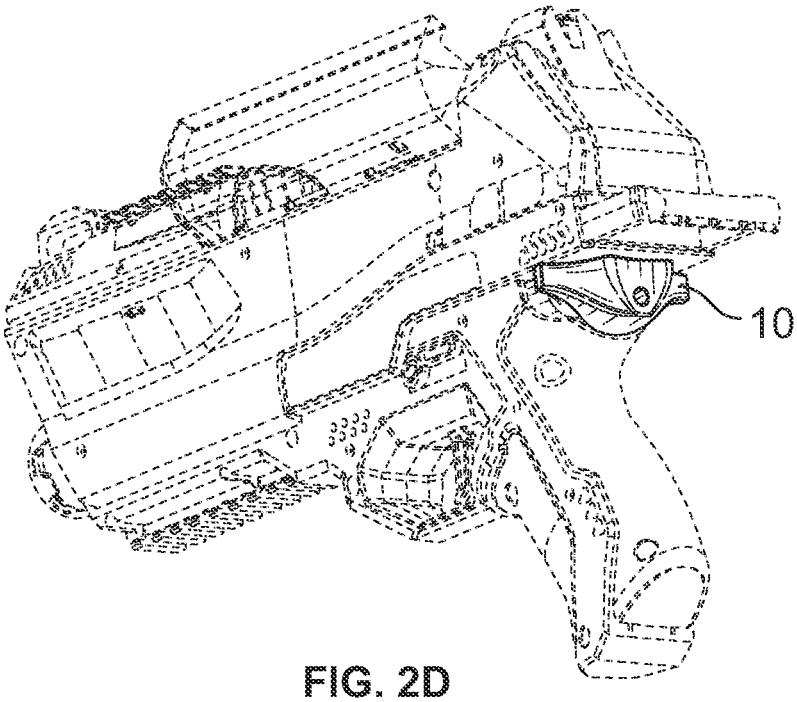
Figure 2E:
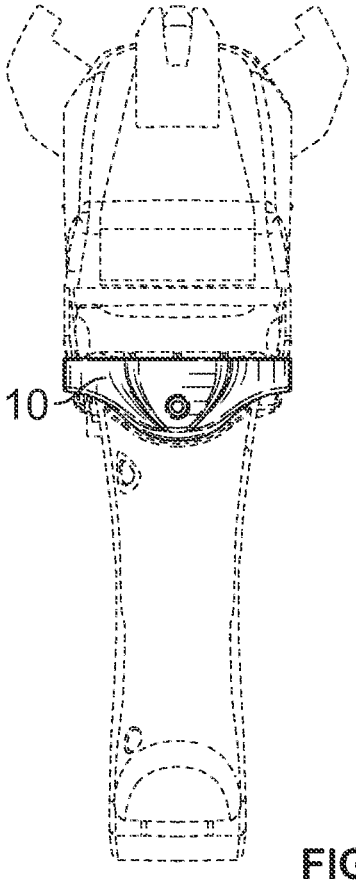
Figure 2F:
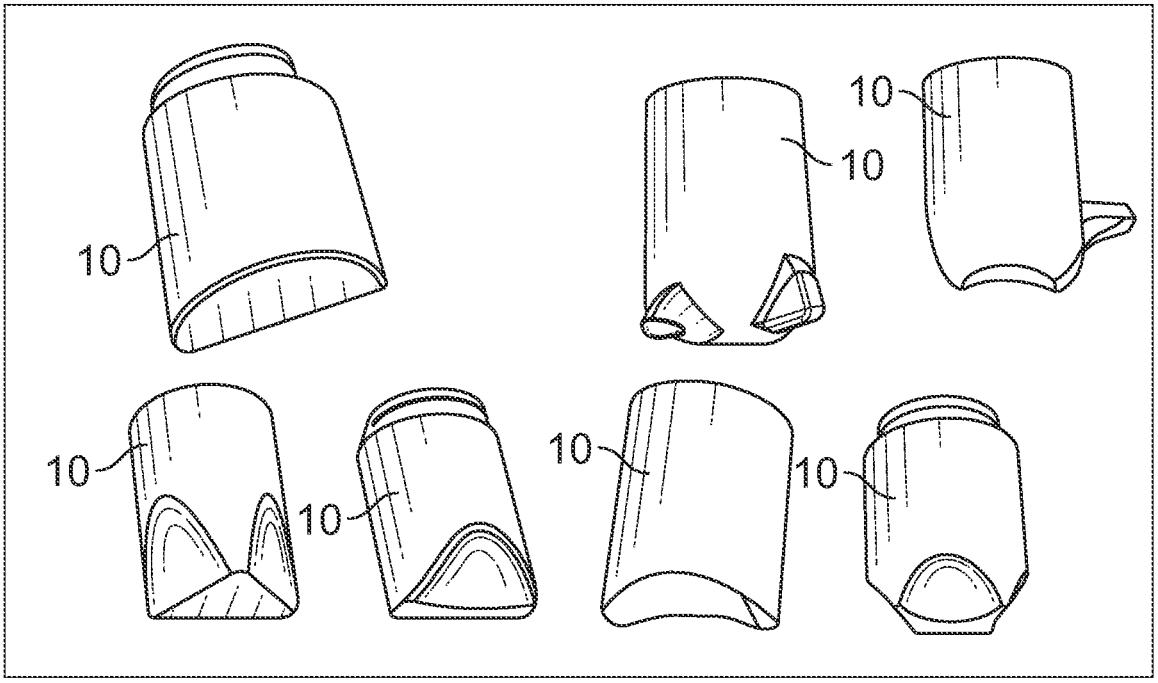

FIGS. 2C-2F show a collection of alternate shaped button 10 embodiments, and particularly FIGS. 2C, 2D, and 2E illustrate the use of alternate shaped button 10 embodiments configured for actuation in various different fashions as an actuator button 10 engages as being pressed for open, closed, side release engagements in accordance the inventions, for one or more secondary functions of a rearward grip button or thumb selector for positioning or configuring operation of toy launchers as between one of a first or a second position or configuration on toy launchers. Differing shape of button 10 may facilitate differentiated functions, such as Pivot, rotationally cammed in/out translated movement action, e.g., pen click in/out rotation, Joystick, Single click, multi-stage clicks.

Toggle, Split switch L/R, Deadman switch, as thumb selector for positioning or configuring operation of launchers as between one of a first or a second position or configuration on a rearward grip location with secondary functions and the like. A ball curve-ball feature may also be facilitated with button 10 being depressed, or moving from side to side, or via a split left right double button in the alternative for moving a shaft, linkage and the lever to the left, or right and discharging a ball or other projectile that will curve the projectile to the left or right. It is to be noted that the button 10 may also be moved to a predetermined position other than fully left or fully right. The button 10 may be moved partway left or partway right to control the curved path of the discharging ball. Having the ability to move the lever to the right or to the left allows the user to hit targets that may be behind obstructions, giving the user great flexibility, an advantage over someone using a toy launcher that does not have the curve-ball feature.

Figure 3A:
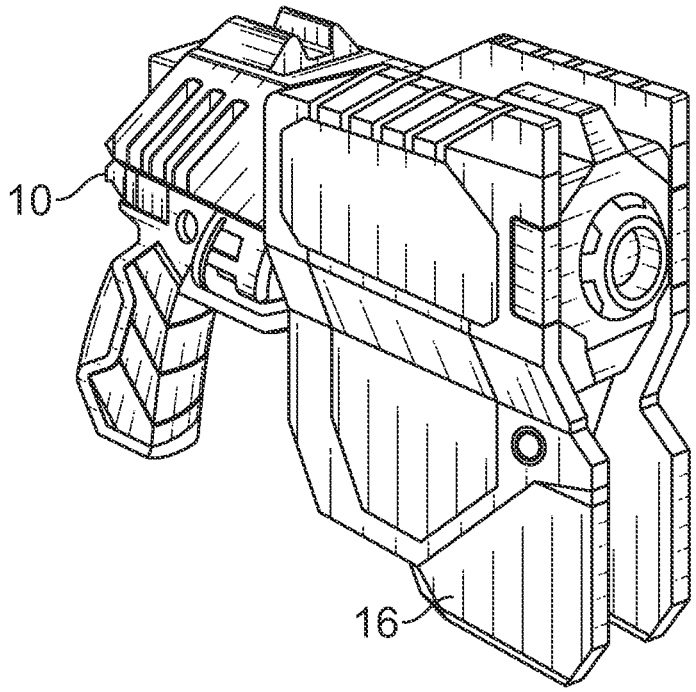
FIGS. 3A and 3B are perspective views of launcher embodiments where the actuator button engages fold out battle shield, opening the shields with the button shown when pressed but folded closed when released, actuating doors in accordance the inventions.
Figure 3B:
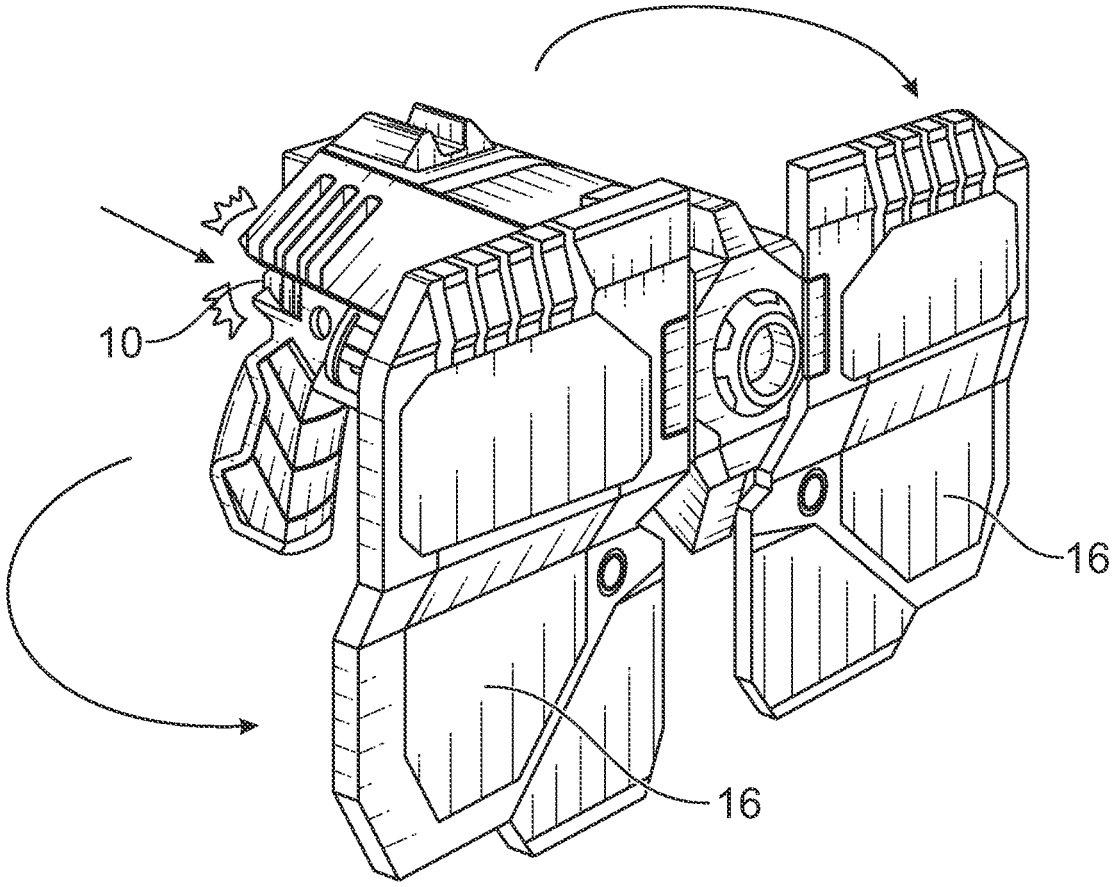

FIGS. 3A and 3B are first perspective views of launcher embodiments where the actuator button 10 engages fold out battle shield doors 16, where FIG. 3B shows the actuator button 10 depressed to engage the battle shields for folding, opening the shields with the button shown when pressed but folded closed when released, actuating doors in accordance the inventions. Shields stay open while the button is pressed and fold back when button is released, like the hopper doors. In the alternative, Click the button once to unfold/deploy shields and click again to fold back detents, linear translation, e.g., third click and release.

Figure 4A:
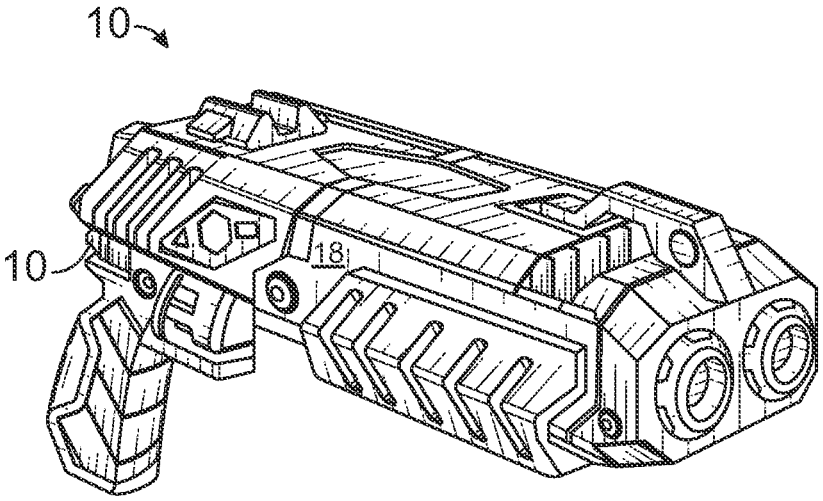
FIGS. 4A and 4B are perspective views of launcher embodiments where the actuator button engages blaster break barrel latching to open and then manually close, in accordance the inventions.
Figure 4B:
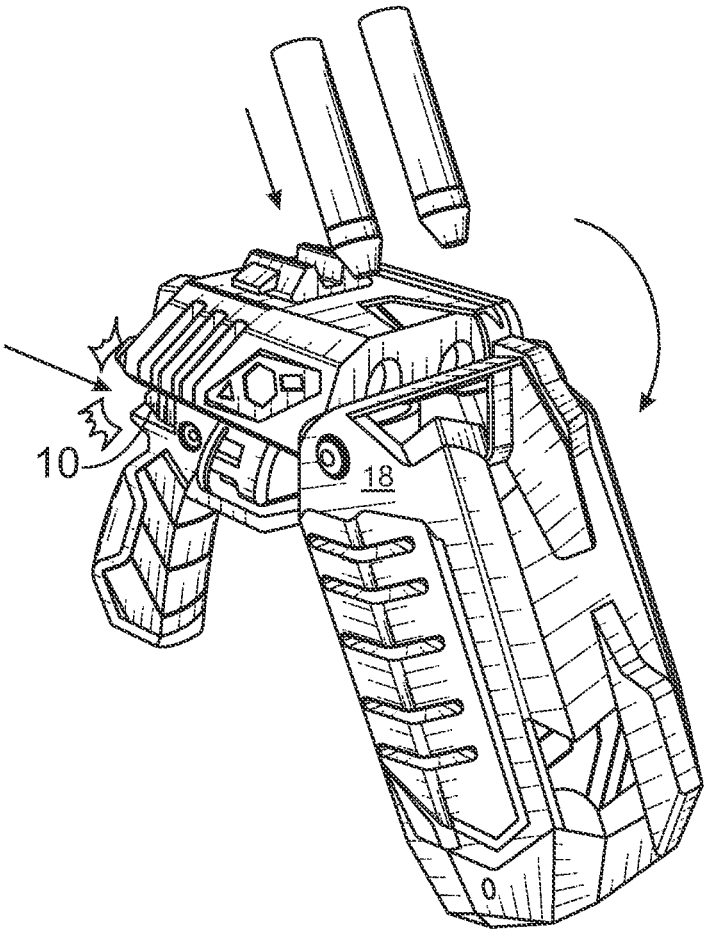

FIGS. 4A and 4B are perspective views of launcher embodiments where the actuator button 10 engages blaster break barrel latching 18, where FIG. 4B shows the actuator button 10 depressed to engage break barrel latches, opening the blaster barrel for loading with the button shown when pressed and allowing latched closed when released, actuating break barrel, e.g., open and then manually close.

Figure 5A:
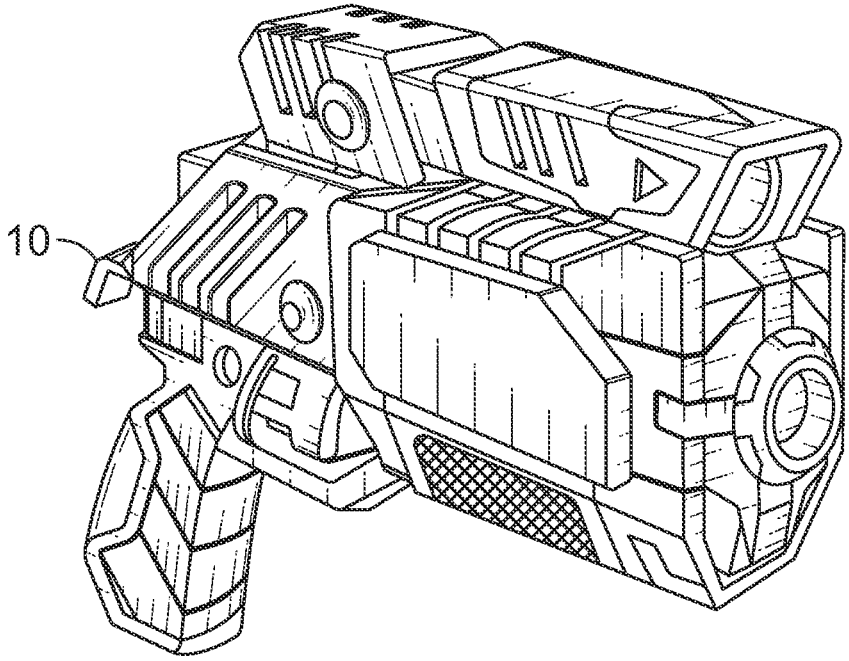
FIGS. 5A and 5B are perspective views of launcher embodiments where the actuator button engages for selectable 1:1-1:3 scope zoom for selected operation with the button shown when pressed and allowing indexed selection when moved in and out, actuating scope zoom in accordance the inventions.
Figure 5B:
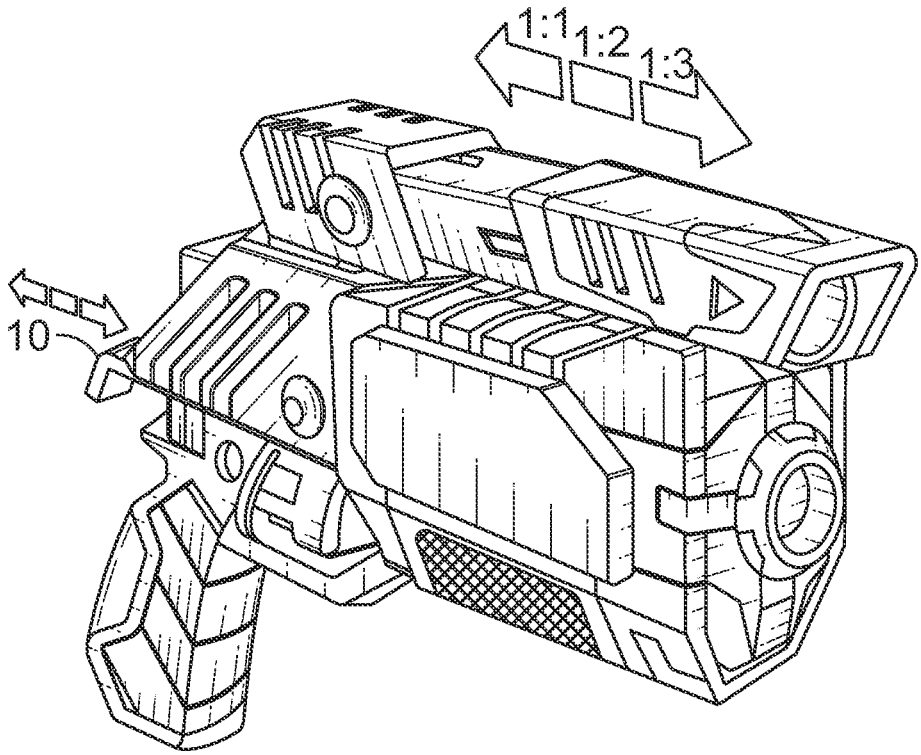
Figure 6A:
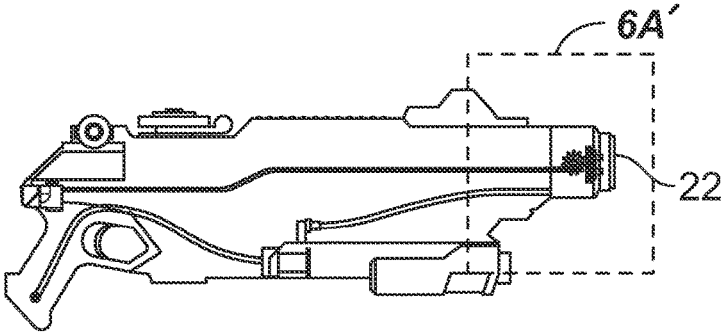
FIGS. 6A, 6B, and 6C, respectively FIGS. 6A', 6B', and 6C' are a series of side and perspective views, showing an exemplary Super Soaker® blaster with inset enlarged semi-transparent views of a launcher in accordance with a further embodiment of the inventions wherein the launcher facilitates Water Nozzle Adjustments.
Figure 6A:
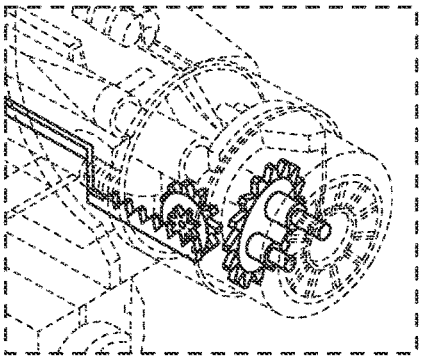
Figure 6B:
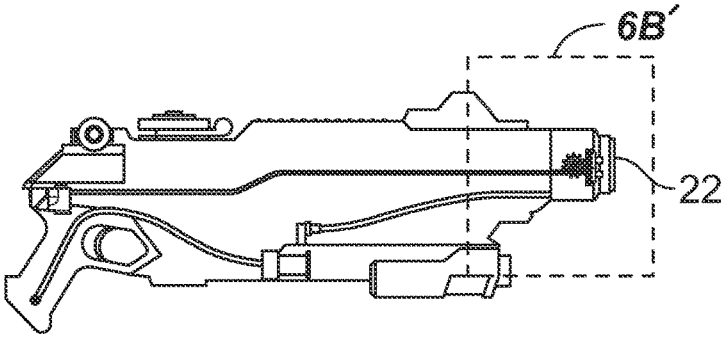
Figure 6B:
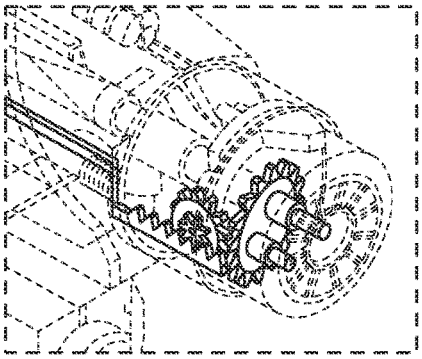
Figure 6C:
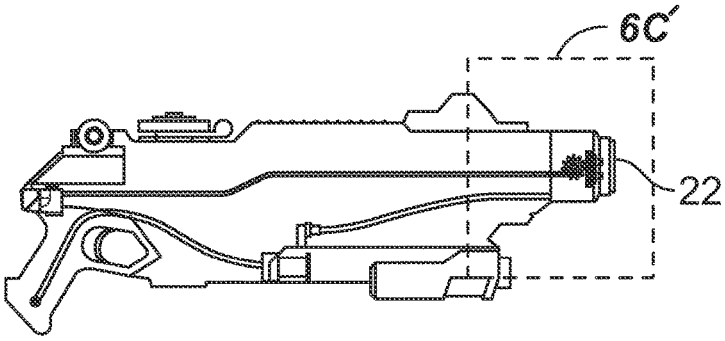
Figure 6C:
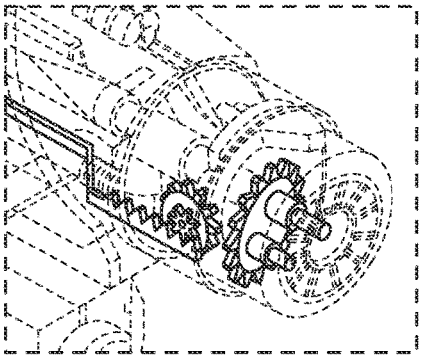

FIGS. 5A and 5B are perspective views of launcher embodiments where the actuator button 10 engages for selectable 1:1-1:3 scope zoom 20, where FIG. 5B shows the actuator button 10 pressed with a series of detents, selectable sequentially, or as detent stops to engage selectable scope zoom settings, moving the scope zooms for selected operation with the button shown when pressed and allowing indexed selection when moved in and out, actuating scope zoom in accordance the inventions FIGS. 6A, 6B, and 6C, respectively FIGS. 6A', 6B', and 6C' are a series of side and perspective views, showing an exemplary Super Soaker® blaster with inset enlarged semi-transparent views of a launcher in accordance with a further embodiment of the inventions wherein the launcher contains nozzle Adjustment Gear 22 with at least two nozzles and/or chambers that are toggled or selectable switched to alternative positions in response to the optional depression of the manual actuator, one series with the button open or undepressed, one with the button half-pressed or half depressed, and one with the button fully pressed or depressed, wherein the three pairs of views correspond to wherein the button or manual actuator is undepressed, pressed, and then again undepressed after the being released.

Figure 7A:
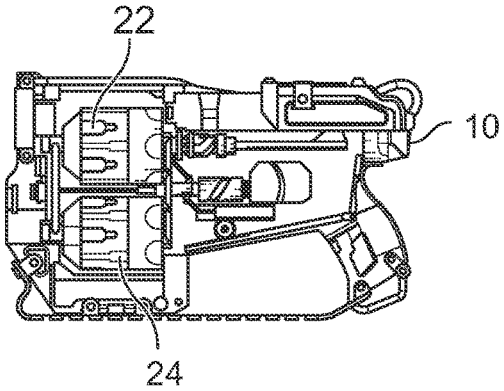
FIGS. 7A, 7B, and 7C, respectively FIGS. 7A', 7B', and 7C' are a series of side and inset views, showing rotatable Barrels via barrels or cartridge release linkage operable with the rear actuator button in accordance with a further embodiment of the inventions.
Figure 7A:
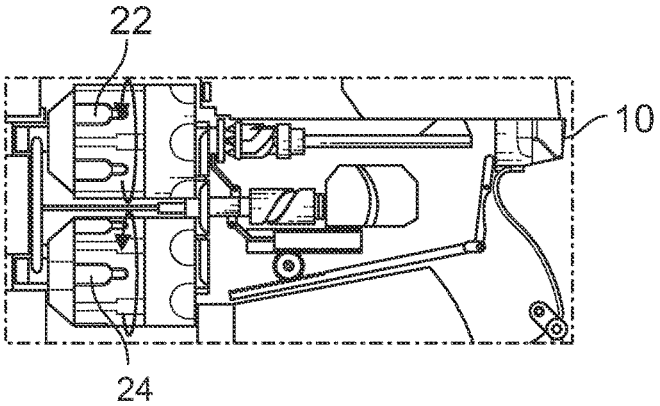
Figure 7B:
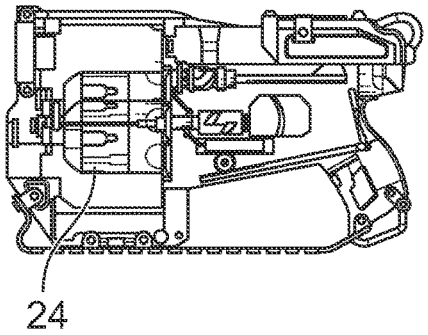
Figure 7B:
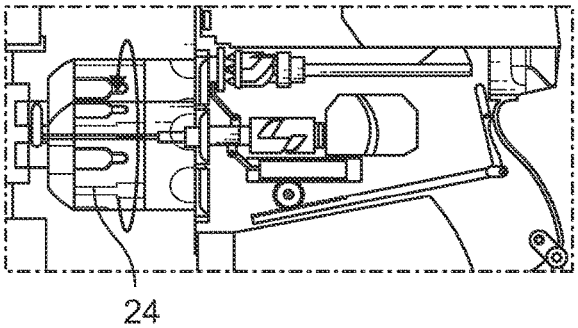
Figure 7C:
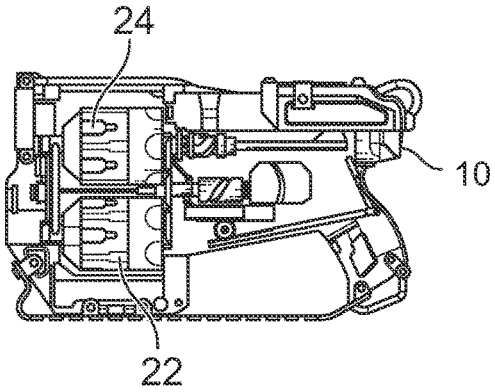
Figure 7C:
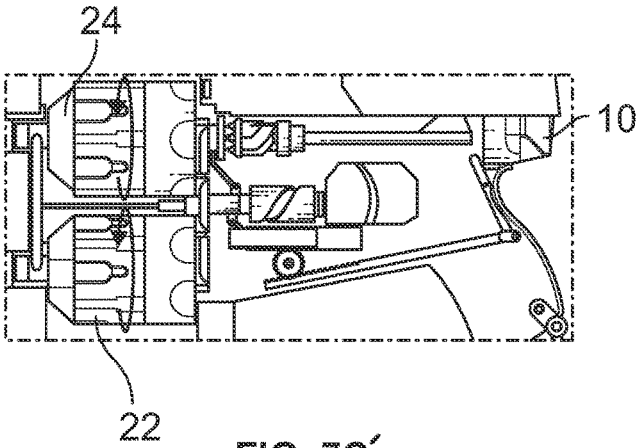
Figure 8A:
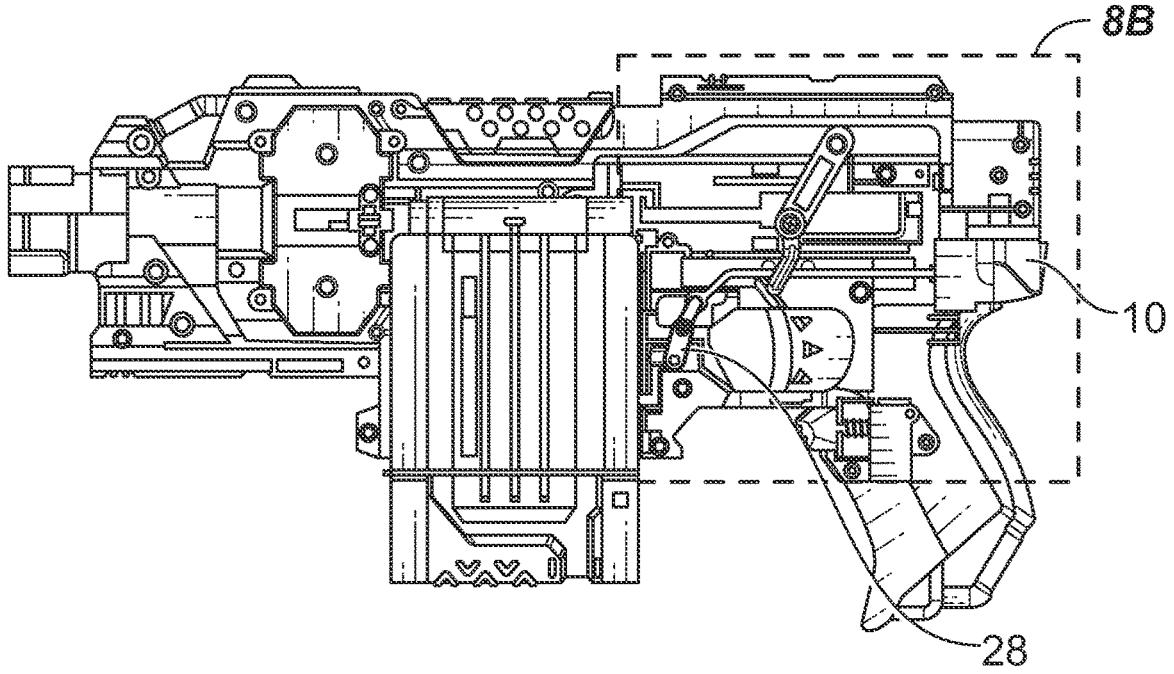
FIGS. 8A, 8B, and 8C, and 8D are a series of side and inset views, showing a magazine/cartridge release linkage with the rear actuator button operable in accordance with a further embodiment of the inventions.
Figure 8B:
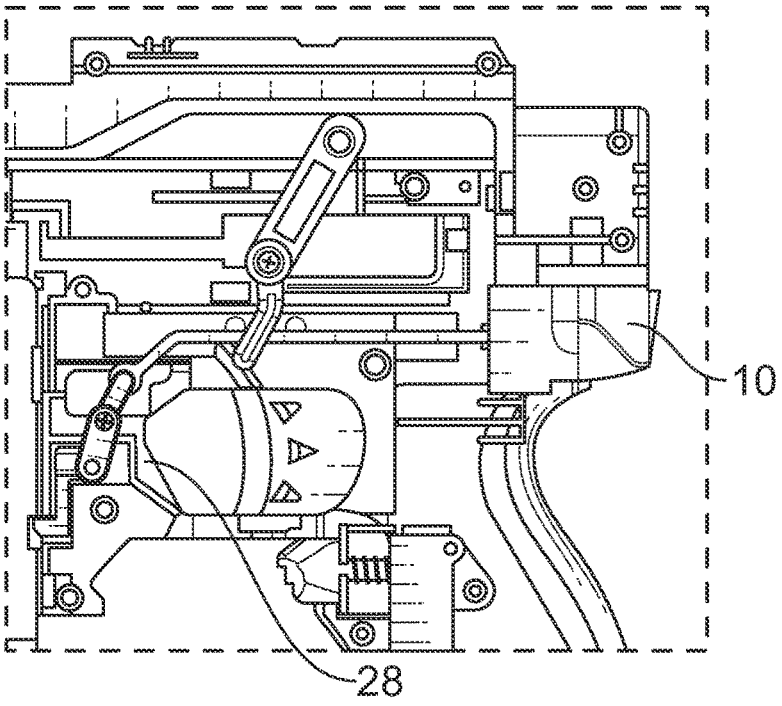
Figure 8C:
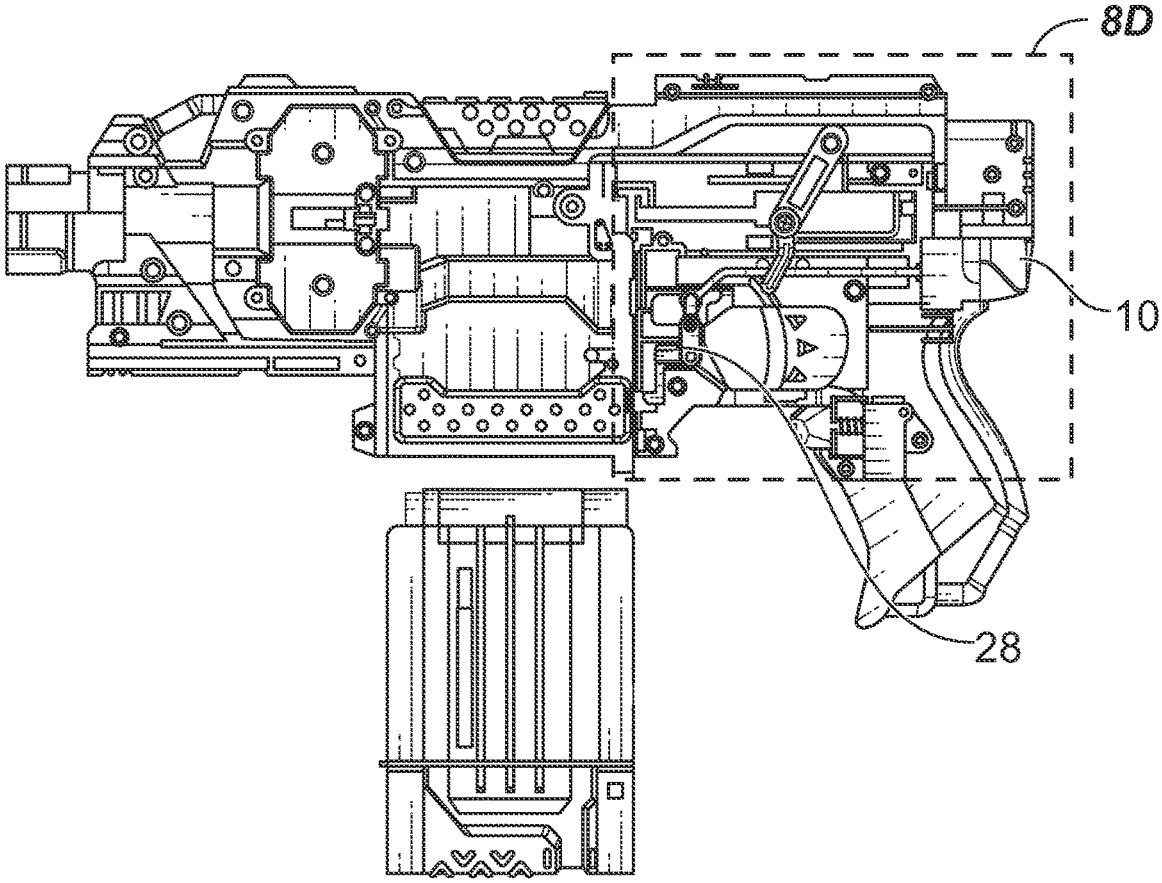
Figure 8D:
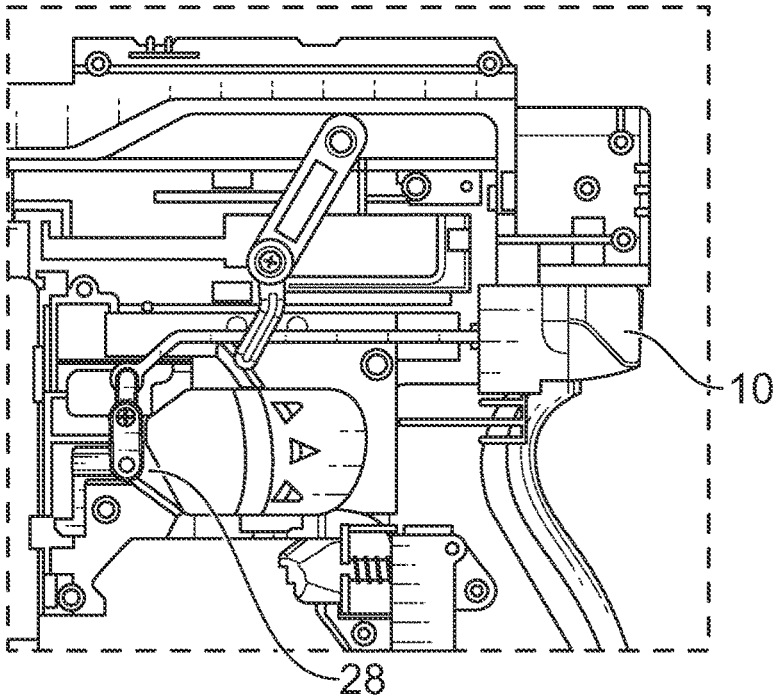

FIGS. 7A, 7B, and 7C, respectively FIGS. 7A', 7B', and 7C' are a series of side and inset views, showing rotatable Barrels 22, 24 via barrels or cartridge release linkage operable with button 10 operable in accordance with a further embodiment of the inventions, wherein from undepressed button or manual actuator while the bottom pair shows a depressed button or manual actuator that may actuate as toggled or selectable switched to alternative positions in response to the optional depression of the manual actuator, one series with the button open or undepressed, one with the button half-pressed or half depressed, and one with the button fully pressed or depressed, wherein the three pairs of views correspond to cartridge/barrel flip functions, associated with launching balls, darts, water spray, and the like.

FIGS. 8A, 8B, and 8C, and 8D are a series of side and inset views, showing a magazine/cartridge release linkage 28 as button 10 operable in accordance with a further embodiment of the inventions, wherein from undepressed button or manual actuator while the bottom pair shows a depressed button or manual actuator that may actuate one or more of the rev switch, the spinning wheels, and/or release attachment of the magazine/cartridge/barrel flip functions and the like. The launch apparatus may be further provided with a selector mounted for translatable movement separately using positions. A select grip handle, for movement, rearward the grip for alternate manual movement not solely tied to trigger grip, as discussed herein. In certain embodiments the toy launch apparatus and methods include a dual triggered or multiple interlock facilitate toy projectiles launching with the clips carriage mounted for individual projectile feeding and launch.

Figure 9A:
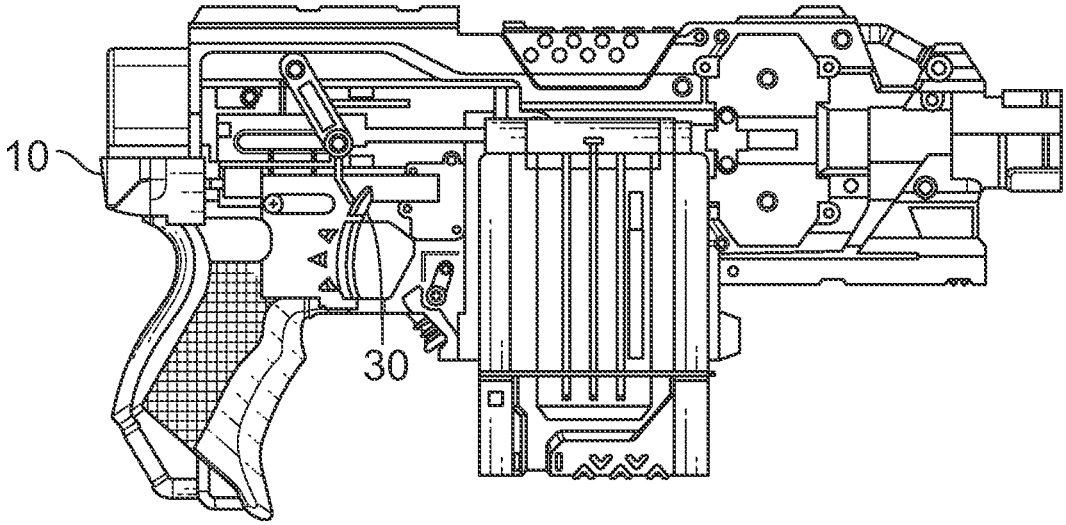
FIGS. 9A, and 9B are side and inset views, respectively showing a Rev Trigger linkage of a launcher in accordance with an alternate embodiment of the invention, allowing for either use by the user with the thumb switch in accordance with the present invention.
Figure 9B:
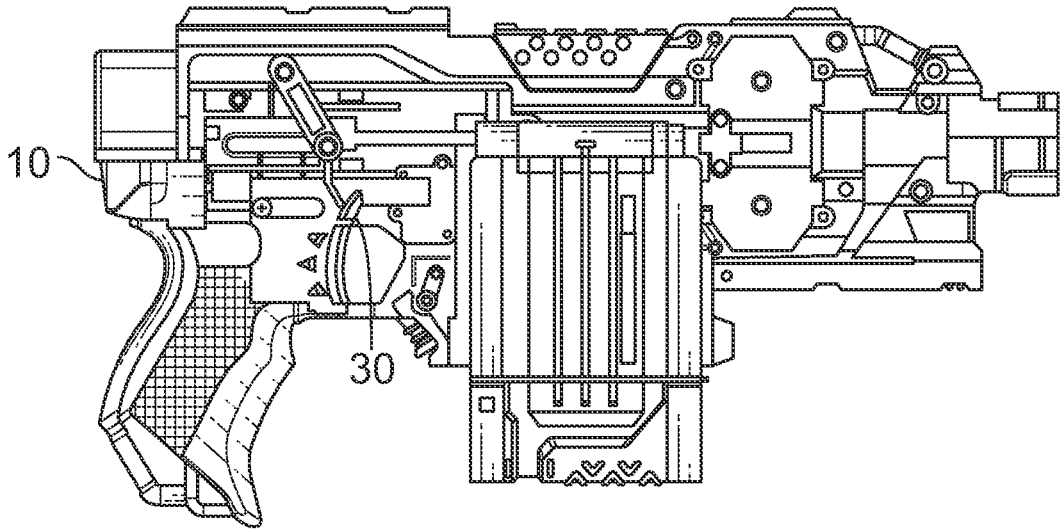

FIGS. 9A, and 9B are side and inset views, respectively showing a Rev Trigger linkage 30 of a launcher in accordance with an alternate embodiment of the invention where the top pair of views shows an undepressed button or manual actuator while the bottom pair shows a depressed button or manual actuator that may actuate one or more of the Rev switch coupled via an electrical source for the spinning wheels launch mechanisms in the alternative, allowing for either use by the user with the thumb switch as alternate to finger operations of such Rev Trigger directly, and the like in combination.

Figure 10A:
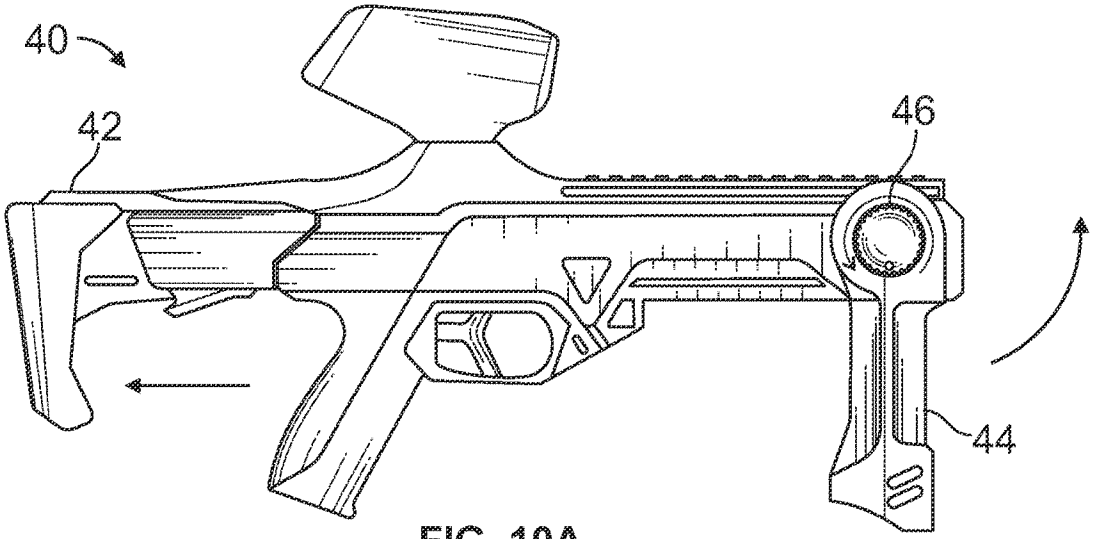
FIGS. 10A and 10B are side elevational views of secondary functions featured launcher embodiments one or more electronic switches illustrating compact and extended featured launcher embodiments respectively.
Figure 10B:
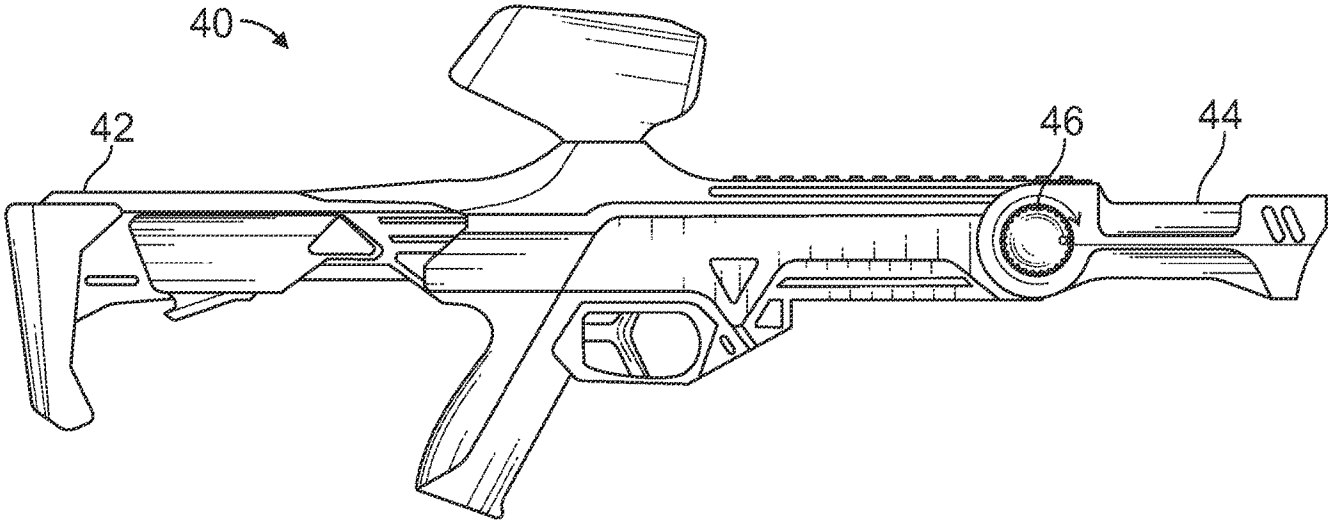
Figure 10C:
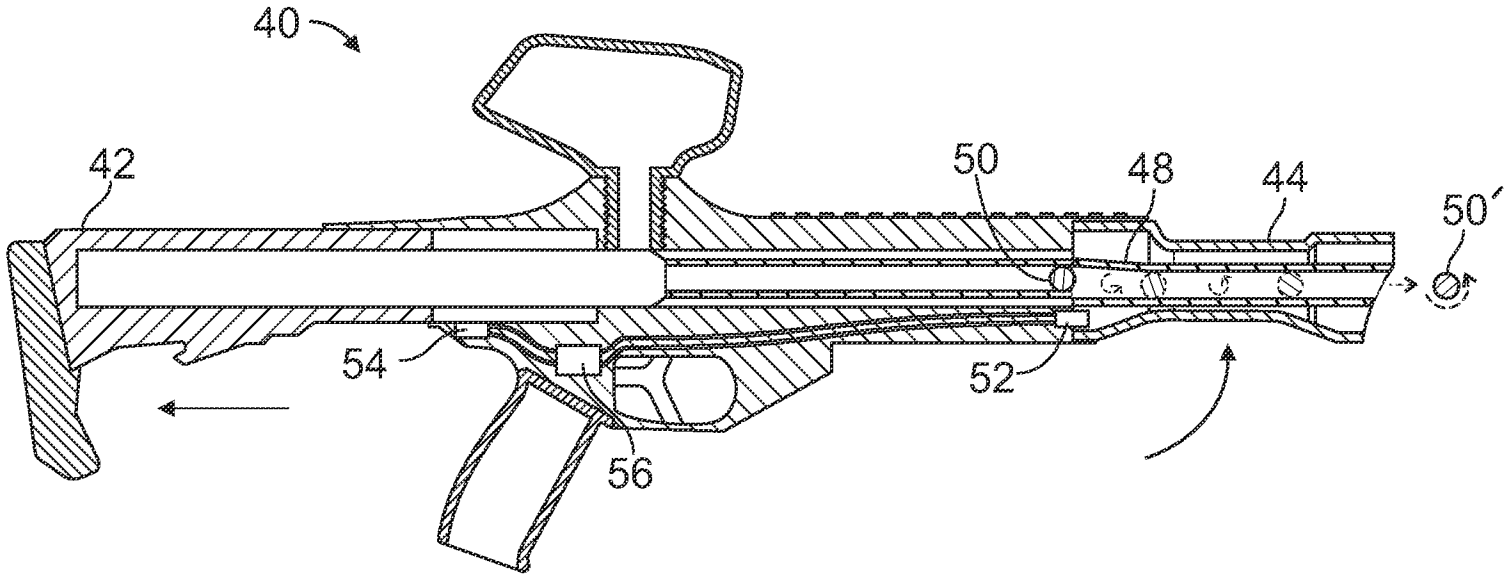
FIGS. 10C and 10D are cross-section views of FIG. 10B illustrating extended featured launcher embodiment functions.
Figure 10D:
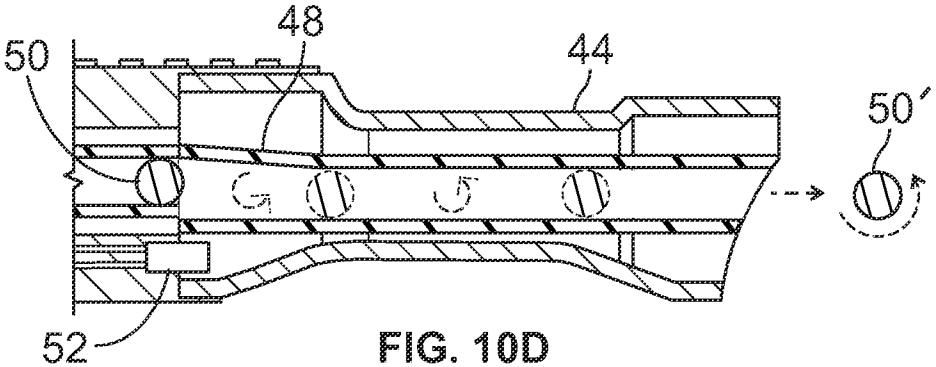

FIGS. 10A and 10B are side elevational views of secondary functions featured launcher embodiments one or more electronic switches illustrating compact and extended featured launcher embodiments respectively. The secondary functions featured launcher embodiments 40, 40' and 40" additionally may include one or more handle portions 42, 44 at the outer housing for grasping with the user's hand. With reference to FIGS. 10A and 10B, portion 42 is a manually extendable stock. Referring particularly to portion 44 reconfiguring from FIG. 10A to FIG. 10B of manually rotatable forward barrel/forward handle 44 as provided being upwardly rotated to a forward extended orientation; FIG. 10B facilitates functional modification introducing hop-up shooting features discussed with further modes of operation discussed herein, actuating rounds 50, 50' projectile hop-up and semi-automatic operations in the extended configuration. In FIG. 10B, on the other hand, with forward handle 44 being downward, as rotated down portion 44 serves as a forward handle 44 for used by the user in compact fully automatic operations. An exit aperture disposed in relation to a forward end of the outer housing, with the exit aperture being in general alignment with the chamber such that upon use of the trigger launching is provided with forward momentum through the exit aperture. A manual actuator is disposed in relation to the one or more handle portions of the outer housing for optional use to actuate a feature of the toy launcher to reconfigure, adjust, or actuate the launcher. Further reference to FIGS. 10B, 10C, and 10D illustrate manual rotatable switching at 46 through forward handle portion 44 upward positioned now as forward barrel 44. FIGS. 10C and 10D illustrate cross-sectional and enlarged views of FIG. 10B, with enlarged view FIG. 10D showing forward barrel 44 having an extended feature angled ramp hop-up 48 section with functions to impart a back spin to projectile round 50, with the counter clockwise illustrated back spin of projectile 50' as launched with forward momentum through the exit aperture of forward barrel 44 feature rotated that impinges on the barrel bore to achieve a spin effect on projectile due to interference on projectile 50' during travel and release.

One launcher provided with two Battle modes, allowing users to convert their blasters to customize game play styles as game play battlefield conditions change in game. The close-range mode uses the compacted stock, with the shoulder stock inward and forward barrel/forward handle downwardly rotated or collapsed orientation as a foregrip handle in compact mode. The long-range mode uses the extended stock, with the barrel upwardly rotated having the foregrip handle converted to the forward barrel orientation in the long-range mode with the precision barrel hop-up for distance. As shown in cross section in FIG. 10C switches 52 and 54 electronically communicate mode status to a controller 56 of internal electrical/mechanical functionality related to switch 52, 54 engagement or downward rotation of the hop-up 48, when the barrel 44 mechanically activating electronic switch 52 that changes the electronic programing of how the blaster fires. Whereas rotated or collapsed orientation of FIG. 10A deactivates manual the above hop-up, such further rotatable switching at 46 with switch 52 changes functional operation with the rotating barrel downward, FIGS. 10B-D illustrate semi-automatic operations in its extended sniper version configuration in its extended configuration with the shoulder stock outward and forward barrel/forward handle upwardly rotated or extended orientation and at the same time with activated switching for functional modification with the rotating barrel up and forward. Rotate barrel up introduces hop-up and down removes, actuating rounds projectile hop-up and semi-automatic operations in the extended configuration. This provides a change in electronic function that is linked to (and triggered by) a form factor change. This gives the user the choice to have two very different battle experiences on the field. Use of the barrel as it is being rotated for mechanically pressing an electronic switch that changes the electronic programing of how the blaster fires, linked to (and triggered by) the form factor change for choosing different battle experiences by the user on the fly.

Launcher function/modes changes in projectiles/performance aspects, with features of single shot configuration with an extended barrel for a more controlled sniper game play with a hop-up. When the barrel is rotated down (90 Deg down), the hop-up is removed and a switch is engaged to enable continuous running when trigger is pulled for an automatic more agile game play noting the shorter form factor. The form factor directly lends itself to the different game plays. Operations respectively illustrating compact and extended featured launcher embodiment functions as between full automatic operations in its compact configuration with the shoulder stock inward and forward barrel/forward handle downwardly rotated or collapsed orientation of FIG. 10A with deactivated switching for functional modification with the rotating barrel downward, whereas FIGS. 10B-D illustrate semi-automatic operations in its extended sniper version configuration in its extended configuration with the shoulder stock outward and forward barrel/forward handle upwardly rotated or extended orientation and at the same time with activated switching for functional modification with the rotating barrel up and forward. Rotate barrel up introduces hop-up while down removes it; actuating rounds projectile hop-up and semi-automatic operations in the extended configuration.

Figure 10E:
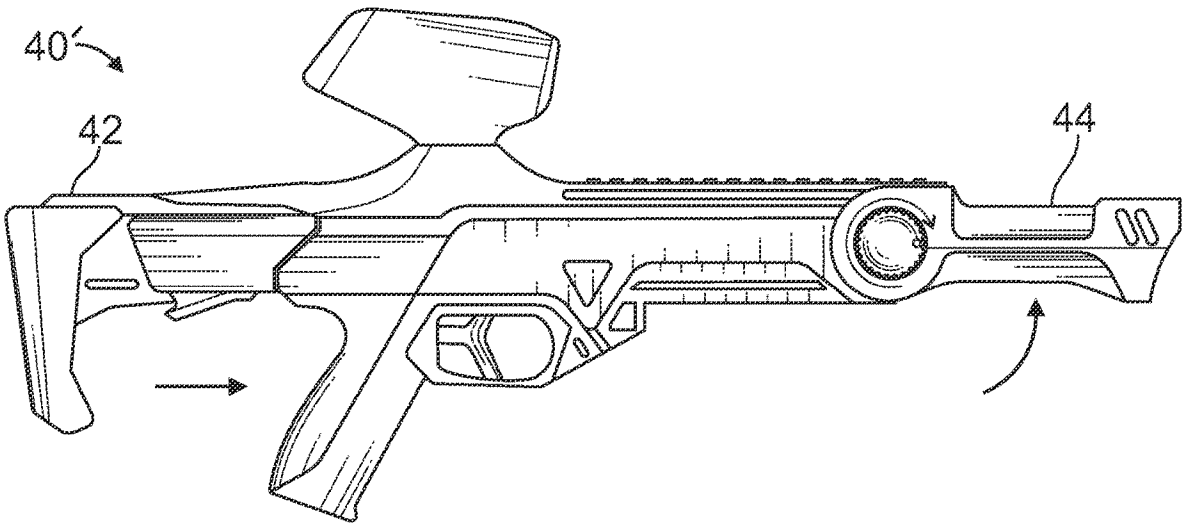
FIGS. 10E & 10F illustrate alternate auto and semi-automatic operations respectively in alternately configured shoulder stock and forward barrel/forward handle orientations in accordance the inventions.
Figure 10F:
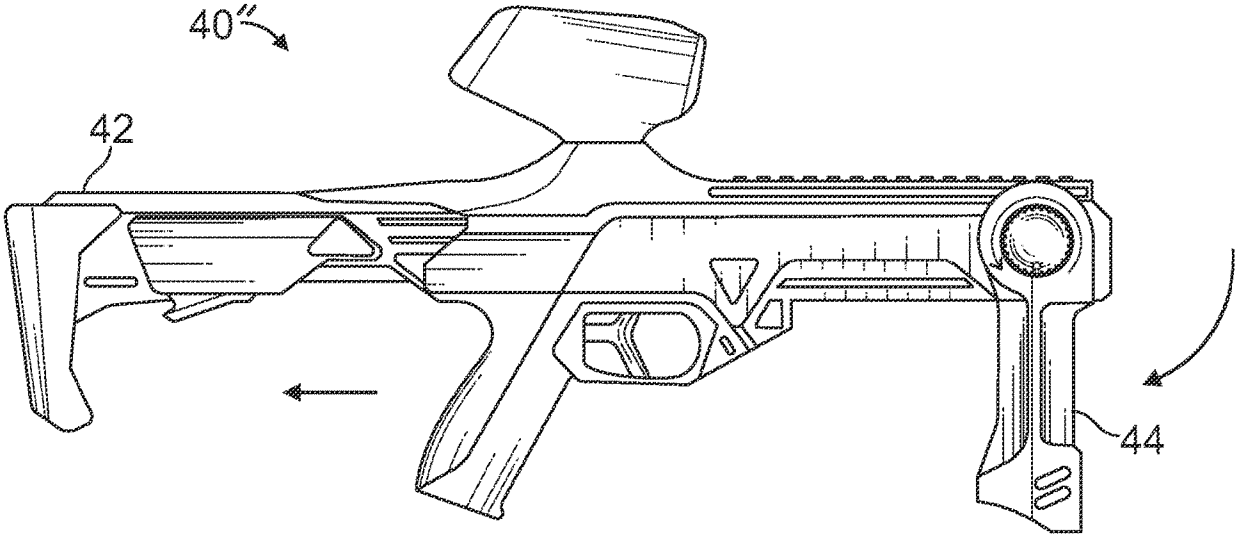

FIGS. 10E & F further illustrate alternate full auto and semi-automatic operations respectively in alternately configured extendable shoulder stock and forward barrel/forward handle orientations of launcher embodiments 40' and 40" in accordance the inventions. Operations respectively illustrating compact and extended featured launcher embodiment functions as between different automatic operations in its compact configuration with the shoulder stock inward and forward barrel/forward handle downwardly rotated or collapsed orientation.

As described the various toy launcher embodiments, apparatus, system, and methods of a chamber within an elongated outer housing for receiving and temporarily containing projectiles or amount of launchable matter. One or more handle portions provided to the outer housing may be used for grasping the toy launcher with a user's hand, and a trigger may be used in launching the projectiles or amount of launchable matter. An exit aperture disposed in relation to a forward end of the outer housing, with the exit aperture being in general alignment with the chamber such that upon use of the trigger launching is provided with forward momentum through the exit aperture. A manual actuator is disposed in relation to the one or more handle portions of the outer housing for optional use to actuate a feature of the toy launcher to reconfigure, adjust, or actuate the launcher. Further toy launcher embodiments may feature the manual actuator disposed for actuation by a thumb on said hand of said user and said trigger is disposed for actuation by another finger on the same hand of said user. Further toy launcher embodiments may feature the manual actuator is depressed generally forwardly against a bias while said trigger is depressed generally rearwardly against a bias. Further toy launcher embodiments may feature the manual actuator includes multiple alternative surfaces by which it may be depressed by said user.

Further toy launcher embodiments may feature the outer housing includes multiple distinct chambers within said housing for receiving and temporarily containing projectiles or launchable matter and said manual actuator toggles between which of said multiple chambers is aligned with said exit aperture such that said projectiles or launchable matter within said aligned chamber may be launched by optional depression of said trigger. Further toy launcher embodiments may feature the chamber contains launchable matter therein and said exit aperture includes a nozzle for controlling the flow of launchable matter therethrough upon optional depression of said trigger and said manual actuator is physically linked with adjusting said nozzle to alter a resistance or dispersion pattern of launchable matter through said exit aperture.

Further toy launcher embodiments may feature a magazine or hopper containing additional launchable projectiles or additional launchable matter, said magazine being manually engageable with said outer housing to permit transfer of said projectiles or matter to said chamber, and wherein optional depression of said manual actuator disconnects or releases said magazine from said outer housing. Further toy launcher embodiments may feature a pair of spinnable wheels for transferring energy to a projectile causing it to launch, said launcher further comprising a switch for altering the spinning speed for one or both of said pair of wheels thereby affecting the exit velocity and/or spin of said projectile upon exit from said launcher. Further toy launcher embodiments may feature the manual actuator may be optionally depressed to control said switch.

Further toy launcher embodiments may feature an extension, a shield or the like disposed on said outer housing wherein optional depression of said manual actuator moves said extension from a non-deployed position or orientation to a deployed position or orientation. Further toy launcher embodiments may feature an eyesight scope disposed on said outer housing, said scope having multiple linear positions each having a unique visual zoom ratio, and wherein optionally depressing said manual actuator moves said scope between respective ones of said linear positions. Further toy launcher embodiments may feature the outer housing includes a pivotable forward portion thereof, said pivotable portion including at least part of said chamber, wherein optional depression of said manual actuator rotates said pivotable forward portion relative to the remainder of said outer housing, thereby providing access to the forward portion of said chamber and facilitating manual insertion of a launchable projectile therein.

While a particular embodiment of the present invention has been shown and described, it will be obvious to those skilled in the art that changes, and modifications may be made without departing from the invention in its broader aspects. Therefore, the aim in the appended claims is to cover all such changes and modifications as fall within the true spirit and scope to the invention. The matter set forth in the foregoing description and accompanying drawings is offered by way of illustration only and not as a limitation. The actual scope to the invention is intended to be defined on the following claims when viewed in their proper perspective based on the prior art.

What is claimed is:

1. A toy launcher for a user to launch a projectile, said toy launcher comprising:

an elongated outer housing;

a chamber within said outer housing for receiving and temporarily containing projectiles;

at least one handle portion of said outer housing for single-handed grasping of said toy launcher by a hand of said user;

a trigger for use in launching said projectile;

an exit aperture disposed in relation to a forward end of said outer housing, said exit aperture being in general alignment with said chamber such that upon use of said trigger said projectile is launched with forward momentum through said exit aperture; and a manual actuator disposed to be directly pressed forwardly against a manual actuator bias by a thumb on said hand of said user in relation to said at least one handle portion of said outer housing for optional use by said user to directly actuate an optional feature of said toy launcher, wherein said manual actuator bias maintains said optional feature in a first mechanically closed position, with said manual actuator bias allowing use with said thumb for directly opening said optional feature to a second mechanically open position while said trigger is depressed generally rearwardly against a trigger bias during use of said toy launcher.

2. The toy launcher in accordance with claim 1, wherein said manual actuator is disposed on an end of said outer housing for optional use by said user to actuate a feature of said toy launcher.

3. The toy launcher in accordance with claim 1, wherein said trigger is generally adjacent said handle portion.

4. The toy launcher in accordance with claim 1, wherein said manual actuator is disposed on an end of said outer housing, with the trigger being disposed for actuation by a finger on said hand of said user other than said thumb.

5. The toy launcher in accordance with claim 4, wherein said manual actuator positions as between one of a first and a second configuration with said manual actuator for optional secondary features of non-launching use in relation to said at least one handle portion.

6. The toy launcher in accordance with claim 4, wherein said manual actuator comprises a button actuator having a surface used by the user.

7. The toy launcher in accordance with claim 4, wherein said manual actuator comprises a multidirectional button actuator disposed at a rear end of the outer housing for manual actuation with said thumb.

8. The toy launcher in accordance with claim 4, wherein said manual actuator comprises an in/out translated movement action button actuator disposed at a rear end of the outer housing for manual actuation with said thumb.

9. The toy launcher in accordance with claim 4, wherein said manual actuator comprises a rotational movement action button actuator disposed at a rear end of the outer housing for manual actuation with said thumb.

10. The toy launcher in accordance with claim 7, wherein said multidirectional button actuator includes multiple alternative surfaces by which it may be used by said user.

11. The toy launcher in accordance with claim 7, wherein said multidirectional button actuator actuates with said thumb to multiple positions for optional secondary features of non-launching use of the toy launcher from said multidirectional button actuator.

12. A toy launching method to launch a projectile or amount of launchable matter, comprising the steps of:

providing an outer housing having a chamber within for receiving and temporarily containing projectiles or launchable matter therein, with a handle portion of the outer housing for single-handed grasping by a hand of a user;

positioning a trigger generally adjacent the handle portion, the trigger being optional depressed by the user to cause the launch of the projectile or the amount of launchable matter;

disposing an exit aperture on a forward end of the outer housing, the exit aperture being in general alignment with the chamber such that upon use of the trigger, the projectile or amount of launchable matter is launched with forward momentum through the exit aperture; and disposing a manual actuator on a rear end or side of the outer housing for optional use by a thumb on said hand of said user for optional depression forwardly against a manual actuator bias by the user to directly actuate an optional feature of the toy launcher, wherein said step of disposing the manual actuator provides that the manual actuator bias closes said optional feature of said toy launcher and maintains said optional feature as closed, with said manual actuator bias allowing use with said thumb for directly opening said optional feature to a second mechanically open position while said trigger is depressed generally rearwardly against a trigger bias during use of said toy launcher.

13. The toy launching method in accordance with claim 12, wherein the trigger is disposed for actuation by another finger other than the thumb on the same hand of the user, the manual actuator being a multidirectional button actuator disposed at a rear end of the outer housing for optional use by the user.

* * * * *